US006922131B2

(12) United States Patent
Walsh et al.

(10) Patent No.: US 6,922,131 B2
(45) Date of Patent: Jul. 26, 2005

(54) ELECTRICAL DEVICE

(75) Inventors: Cecilia A. Walsh, Minnetonka, MN (US); Rodrigo Rubiano, Redwood City, CA (US); Albert R. Martin, Oakland, CA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/716,315

(22) Filed: Nov. 17, 2003

(65) Prior Publication Data

US 2004/0136136 A1 Jul. 15, 2004

Related U.S. Application Data

(63) Continuation of application No. 09/757,436, filed on Jan. 10, 2001, now abandoned.
(60) Provisional application No. 60/175,582, filed on Jan. 11, 2000.

(51) Int. Cl.[7] ..... H01H 85/06; H01C 7/02
(52) U.S. Cl. ..... 337/167; 337/159; 337/186; 337/416; 361/106; 338/22 R; 338/204
(58) Field of Search ..... 337/12, 14, 158, 337/186, 187, 167, 290, 295–297, 159, 377, 416; 361/103, 106; 338/22 R, 23, 204, 205; 323/369

(56) References Cited

U.S. PATENT DOCUMENTS

| | | | | |
|---|---|---|---|---|
| 2,027,962 A | | 1/1936 | Currie | 18/55 |
| 2,870,307 A | | 9/1959 | Milliken et al. | 338/22 R |
| 3,086,242 A | | 4/1963 | Cook et al. | 18/1 |
| 3,138,686 A | | 6/1964 | Mitoff et al. | 200/142 |
| 3,214,719 A | | 10/1965 | Turner | 338/22 |
| 3,310,766 A | | 3/1967 | Downing et al. | 338/20 |
| 3,597,372 A | | 8/1971 | Cook | 260/4 |
| 4,223,177 A | | 9/1980 | Nakamura | 174/52 S |
| 4,223,209 A | | 9/1980 | Diaz | 219/549 |
| 4,237,441 A | | 12/1980 | van Konynenburg | 338/22 R |
| 4,267,635 A | * | 5/1981 | Blaha | 29/622 |
| 4,315,237 A | | 2/1982 | Middleman et al. | 338/22 R |
| 4,327,282 A | | 4/1982 | Nauerth | 338/22 R |

(Continued)

FOREIGN PATENT DOCUMENTS

| | | | | |
|---|---|---|---|---|
| DE | 3632598 A1 | * | 4/1988 | H01C/1/16 |
| EP | 0 312 485 A | | 4/1989 | |
| EP | 0 322 339 A | | 6/1989 | |
| EP | 534775 A1 | * | 3/1993 | H01C/1/14 |
| WO | WO00/74081 A | | 12/2000 | |

OTHER PUBLICATIONS

International Search Report for International Application No. PCT/US00/15361, dated Aug. 23, 2000.
International Search Report for International Application No. PCT/US01/00803, dated Jun. 15, 2001.
Underwriter's Laboratory Standard 1950, 3rd edition, Safety of Information Technology Equipment, Sections 6.5 ("Protection of the telecommunication wiring system from overheating"), 6.6 ("Protection against overvoltage from power line crosses"), and Appendix NAC ("Power line crosses"), pp. 145–148, 237–242, 1998.

(Continued)

*Primary Examiner*—Anatoly Vortman

(57) ABSTRACT

An electrical device suitable for use in digital telecommunications applications is provided. The device includes a laminar PTC element composed of a conductive polymer composition sandwiched between two metal foil electrodes. A first insulating layer which is composed of an electrically insulating flexible material conforms to at least part of the perimeter of the PTC element. The device has low resistance, low capacitance, reduced size, and stable resistance, and can meet power cross testing requirements. In addition, assemblies of electrical devices are provided.

5 Claims, 2 Drawing Sheets

U.S. PATENT DOCUMENTS

| | | | | | |
|---|---|---|---|---|---|
| 4,371,860 | A | | 2/1983 | May et al. | 338/21 |
| 4,450,871 | A | | 5/1984 | Sato et al. | 138/140 |
| 4,481,498 | A | | 11/1984 | McTavish et al. | 338/20 |
| 4,517,449 | A | | 5/1985 | Chazan et al. | 219/549 |
| 4,545,926 | A | | 10/1985 | Fouts et al. | 252/511 |
| 4,689,475 | A | | 8/1987 | Kleiner et al. | 219/553 |
| 4,724,417 | A | | 2/1988 | Au et al. | 338/22 R |
| 4,752,762 | A | | 6/1988 | Inano et al. | 338/22 R |
| 4,774,024 | A | | 9/1988 | Deep et al. | 252/511 |
| 4,800,253 | A | | 1/1989 | Kleiner et al. | 219/553 |
| 4,845,838 | A | | 7/1989 | Jacobs et al. | 29/671 |
| 4,859,836 | A | | 8/1989 | Lunk et al. | 219/548 |
| 4,873,507 | A | | 10/1989 | Antonas | 338/22 R |
| 4,904,850 | A | | 2/1990 | Claypool et al. | 219/548 |
| 4,935,156 | A | | 6/1990 | van Konynenburg et al. | 219/553 |
| 5,049,850 | A | | 9/1991 | Evans et al. | 338/22 R |
| 5,122,775 | A | | 6/1992 | Fang et al. | 338/22 R |
| 5,142,265 | A | | 8/1992 | Motoyoshi et al. | 338/22 R |
| 5,189,387 | A | | 2/1993 | Childers et al. | 338/20 |
| 5,210,516 | A | | 5/1993 | Shikama et al. | 338/22 R |
| 5,210,517 | A | | 5/1993 | Abe | 338/22 R |
| 5,250,228 | A | | 10/1993 | Baigrie et al. | 252/511 |
| 5,303,115 | A | * | 4/1994 | Nayar et al. | 361/106 |
| 5,358,793 | A | | 10/1994 | Hanada et al. | 428/560 |
| 5,378,407 | A | | 1/1995 | Chandler et al. | 252/513 |
| 5,382,938 | A | * | 1/1995 | Hansson et al. | 338/22 R |
| 5,451,919 | A | | 9/1995 | Chu et al. | 338/22 R |
| 5,582,770 | A | | 12/1996 | Chu et al. | 252/511 |
| 5,747,147 | A | | 5/1998 | Wartenberg et al. | 428/209 |
| 5,852,397 | A | | 12/1998 | Chan et al. | 338/22 R |
| 5,874,885 | A | * | 2/1999 | Chandler et al. | 338/22 R |
| 5,884,391 | A | | 3/1999 | McGuire et al. | 29/612 |
| 5,900,800 | A | | 5/1999 | McGuire et al. | 338/22 R |
| 5,939,968 | A | * | 8/1999 | Nguyen et al. | 337/12 |
| 5,945,903 | A | * | 8/1999 | Reddy et al. | 337/197 |
| 6,020,808 | A | | 2/2000 | Hogge | 338/22 R |
| 6,130,597 | A | | 10/2000 | Toth et al. | 338/22 R |
| 6,157,528 | A | * | 12/2000 | Anthony | 361/106 |
| 6,177,857 | B1 | | 1/2001 | Inoue | 338/22 R |
| 6,223,423 | B1 | * | 5/2001 | Hogge | 29/621 |
| 6,236,302 | B1 | * | 5/2001 | Barrett et al. | 338/22 R |
| 6,373,372 | B1 | * | 4/2002 | Duggal et al. | 338/22 R |
| 6,531,950 | B1 | * | 3/2003 | Becker et al. | 338/22 R |
| 6,540,944 | B2 | * | 4/2003 | Duggal et al. | 252/503 |
| 6,570,483 | B1 | | 5/2003 | Chandler et al. | 338/22 R |

OTHER PUBLICATIONS

Bellcore GR–1089, "Electromagnetic Compatibility and Electrical Safety—Generic Criteria for Network Telecommunications Equipment", Chapter 4 ("Lightning and AC Power Fault"), issue 2, pp. 4–1 to 4–42, Dec. 1997.

Raychem Circuit Protection Databook, Oct. 1998, pp. 213–224 (description of PolySwitch TR600 devices); p. 84 (description of Level 1 Surge 3 test).

U.S. Appl. No. 08/816,471, Chandler et al., filed Mar. 13, 1997.

U.S. Appl. No. 09/324,351, filed Jun. 2, 1999, Walsh et al.

* cited by examiner

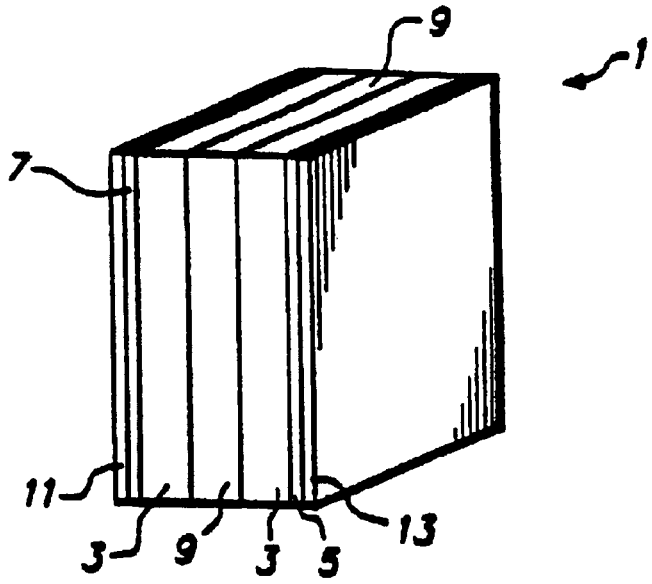
FIG. 1
FIG. 2
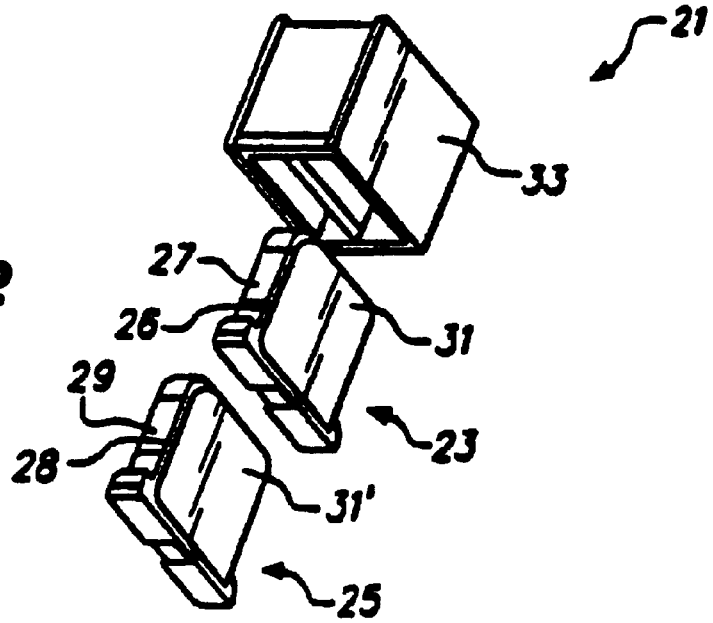

ELECTRICAL DEVICE

CROSS-REFERENCE TO RELATED APPLICATION

This application is a continuation of, commonly assigned Application No. 09/757,436, filed Jan. 10, 2001, now abandoned which is an application under 35 USC 111(a) and claims priority under 35 USC 119 from Provisional Application Ser. No. 60/175,582, filed Jan. 11, 2000 under 35 USC 111(b). The disclosure of these documents is incorporated herein by reference.

BACKGROUND OF THE INVENTION

1. Field of the Invention

This invention relates to an electrical device, particularly to a device to be used in digital telecommunications applications, and to assemblies of electrical devices.

2. Introduction to the Invention

Circuit protection devices are well known. Those circuit protection devices which are particularly useful in some applications, e.g. to protect telecommunications circuits, exhibit positive temperature coefficient of resistance (PTC) behavior, i.e. the resistance increases anomalously from a low resistance, low temperature state to a high resistance, high temperature state at a particular temperature, i.e. the switching temperature $T_S$. Under normal operating conditions, a circuit protection device which is placed in series with a load in an electrical circuit has a relatively low resistance and low temperature. If, however, a fault occurs, e.g. due to excessive current in the circuit or a condition which induces excessive heat generation within the device, the device "trips", i.e. is converted to its high resistance, high temperature state. As a result, the current in the circuit is dramatically reduced and other components are protected. When the fault condition and the power are removed, the device resets, i.e. returns to its low resistance, low temperature condition. Fault conditions may be the result of a short circuit, the introduction of additional power to the circuit, power surges, or overheating of the device by an external heat source, among other reasons. When the device comprises a conductive polymer composition, during the tripping event the device expands as the polymer melts.

Devices intended for use in protecting telecommunications circuits and equipment have special requirements. For example, it is important that the device be tripped by the fault conditions which occur when a power line, i.e. an electrical cable which carries high voltages (e.g. 250 to 600 volts), comes into contact with a telephone line. These fault conditions are often referred to as "power cross". An accepted test for devices which will provide such protection is described in Underwriter's Laboratory Standard 1950 3$^{rd}$ edition, the disclosure of which is incorporated herein by reference. In this test, a device is subjected to an electrical cycle consisting of 600 volts AC and 40 A (short circuit) conditions, with a wiring simulator connected in series with the device. Under such test conditions, it is possible for the device to arc or flashover at the edge from one electrode to the other due to the high power levels. Simultaneously, the device is expanding rapidly in order to absorb the energy associated with the fault condition.

For certain applications, such as for equipment to be used in telephone network circuitry, components to be used in that equipment must meet additional requirements. For example, it is often required that a device meet the applicable tests as put forth in Bellcore GR-1089 specification for Electromagnetic Compatibility and Electrical Safety, the disclosure of which is incorporated herein by reference. One aspect of Bellcore GR-1089 is that a component must survive after exposure to high voltage, high current transients, meant to simulate lightning strikes.

Telephony systems are rapidly evolving due to the increased demand for high speed transmission of large amounts of data which is in the form of digital signals. Devices used in digital telecommunications circuits face requirements which are different from those conventionally required by analog and voice systems. At present, PTC devices with resistances greater than 20 ohms are used in a wide variety of telecommunications systems. For example the Raychem PolySwitch™ TR600-150 device is utilized in telecom applications and can have an installed resistance as high as 22 ohms (see the Raychem Circuit Protection Databook, October 1998, the disclosure of which is incorporated herein by reference). However, with digital circuitry the device resistance must be substantially lower than 20 ohms to minimize the loss of signal and distortion of the signal in the circuit. A typical application might involve the use of one PTC device in the tip section of a telecommunications circuit, and a second PTC device in the ring section. The relative resistances of these two devices must be stable to achieve an optimum signal-to-noise ratio. The device capacitance must be low to allow the transmission without distortion of high bandwidth signals typical of digital information streams. Miniaturization of digital devices requires that the components also be reduced in size, particularly in their "footprint" (i.e. space they require on a circuit board), and in their height off the board (i.e. the distance from the top of the device, including any insulating layers that are present, to the board), so that boards can be mounted into equipment at higher densities. Despite these size, resistance, and capacitance requirements, the device must pass the appropriate tests as outlined above, such as power cross test requirements as specified in UL1950, and lightning surge requirements as put forth in Bellcore 1089.

Use of electrically insulating coatings or housings to surround circuit protection devices and other electrical components is known. See, for example, U.S. Pat. Nos. 4,223,177 (Nakamura), 4,315,237 (Middleman et al), 4,481,498 (McTavish et al), 4,873,507 (Antonas), and 5,210,517 (Abe), the disclosures of which are incorporated herein by reference. Such coatings provide electrical insulation and mechanical protection, and are particularly important for use with devices exposed to high voltage conditions in which arcing from one electrode to the other may occur. However, some conventional coatings, e.g. epoxies, can restrict the expansion of the PTC element, causing the device to fail. Other conventional coatings, which are flexible or conformable, may crack or pull away from the device as a result of the expansion during tripping, leaving the device edges exposed and subject to further arcing. In addition, for a surface mountable device, the coating must remain intact and retain its functionality for inhibiting arcing from one electrode to another after installation on the board, which commonly involves a reflow operation in which solder is heated above its melting temperature.

Existing circuit protection devices for high voltage digital applications have relatively large footprints. For example, devices sold under the tradename PolySwitch® TR600-160 by Raychem Circuit Protection, a division of Tyco Electronics Corporation, meet the requirements of the UL1950 600 VAC, 40 A power cross test as outlined above, and are radial leaded devices which are approximately 6 mm wide. PolySwitch® TS600-200 devices, which are surface mountable, are over 8 mm wide. Because telecommunications equipment such as line cards typically incorporates multiple lines, and each line is usually protected by its own separate circuit protection element, circuit boards often have eight or sixteen such devices mounted as close together as possible. Therefore, reduction in footprint for an individual device provides a multiple benefit for a circuit board. Further reduction in footprint can be achieved by packaging multiple devices together in an assembly.

For digital telecommunications circuits, it is important that the resistance of the series circuit protection elements be reduced to as low a value as possible, while still performing their intended function of protecting against various types of electrical faults. Most speech energy has been determined to be in the frequency range below 3500 Hz. The standard "4 kHz" voice channel universally used in telephone networks is designed to pass frequencies in the range 300–3400 Hz. Analog equipment such as a modem must force data to fit into this channel width by using various techniques, e.g. modulation, to overcome the bandwidth limitations of the telephone channel. However, digital services can provide much higher bandwidths. Digital systems include HDSL (high speed digital subscriber line), which operates at speeds up to 1.5 Mb/s (megabits per second), ADSL (asynchronous digital subscriber line), which operates at download speeds of up to 6 Mb/s and VDSL (very high speed digital subscriber line), which operates at up to 52 Mb/s. Higher speed systems exist for certain applications as well. Copper wire has a certain amount of resistance/length, and signals fade with distance. With amplifiers, the signal can be regenerated to some extent. However, with each amplification of signal, more noise is generated so after a point the use of amplification to transmit quality signals is limited. Any unnecessary resistance directly subtracts from the range the signal can be transmitted, and the quality of the signal. The impedance of the circuit is especially critical for the increased bandwidth requirements for high speed digital transmissions. Impedance mismatches can cause unwanted reflections in the circuits, and other sources of noise. Therefore it is important that impedance balance throughout the circuit be carefully designed and retained as the system is manufactured and operated in the field. Cross talk between lines further limits performance. All of these factors are extremely important in designing and optimizing digital systems, as signal-to-noise becomes a limiting factor in determining the range of the various digital architectures.

One method for reducing the resistance of PTC devices is to make the device larger. However, this approach can produce two deleterious effects. The first is clearly defeating the requirement that the device be as small as possible. For instance, board-to-board spacing in a piece of equipment may be 12.7 mm (0.5 inch), and therefore any device which extends beyond this distance could not be used. The second is that the device has an undesired large thermal mass which can be difficult to solder and may also not meet testing requirements. Besides the high voltage, high current power cross faults, circuit protection devices must also protect equipment against high voltage, low current faults. If the thermal mass of the device is too large, it will not trip under these conditions, where the fault current may be as low as 0.5 A, thereby exposing equipment to failure by a longer term lower energy fault condition.

Ceramic PTC devices have been used as circuit protection elements in telecommunication applications. However, because of the relatively high resistivity of ceramic materials, devices of low resistance will be undesirably large. In addition, the capacitance of the inorganic ceramic devices can be high, on the order of 1 nF, which is undesirable for high speed digital applications. Fuses remain an option for overcurrent protection for some applications; however, they are not resettable which can require undesired repair or replacement of equipment, which is often located in multiple or remote locations, at the manufacturer's cost.

BRIEF SUMMARY OF THE INVENTION

We have now found that is possible to make a PTC electrical device which is capable of meeting the combination of requirements for a circuit protection device for the protection of digital telecommunications equipment which has a reduced size, a resistance which is stable relative to substantially similar devices, and a low capacitance. In addition, the device can retain its functionality following solder-reflow onto a substrate such as a printed circuit board. Thus, in a first aspect this invention provides an electrical device suitable for use in a digital telecommunications circuit, which device has a capacitance of at most 150 pF, said device comprising (1) a laminar PTC element which (a) comprises a conductive polymer composition which exhibits PTC behavior, (b) has first and second major surfaces, (c) has a thickness t mm which is at most 2.5 mm, and (d) has a perimeter p mm which is at most 50 mm;

(2) a first metal foil electrode which is attached to the first surface of the PTC element;

(3) a second metal foil electrode which is attached to the second surface of the PTC element; and (4) a first insulating layer which comprises an electrically insulating material which conforms to at least part of the perimeter of the PTC element;

the device (a) having an initial resistance at 20° C. of at most 6 ohms, (b) meeting the requirements of UL1950 power contact test M-1, and (c) after being subjected to a 250 VAC/3 A test for a period of 15 minutes followed by a period of at least 1 hour during which no power is applied to the device having a resistance which differs by at most 1.5 ohms from that of a substantially similar device subjected to the same electrical test.

In a second aspect, the invention provides an electrical assembly, said assembly comprising (A) first and second electrical devices, each of which devices comprises (1) a laminar PTC element which (a) comprises a conductive polymer composition which exhibits PTC behavior, (b) has first and second major surfaces, (c) has a thickness t mm which is at most 2.5 mm, and (d) has a perimeter p mm which is at most 50 mm;

(2) a first metal foil electrode which is attached to the first surface of the PTC element;

(3) a second metal foil electrode which is attached to the second surface of the PTC element; and (4) a first insulating layer which comprises an electrically insulating material which conforms to at least part of the perimeter of the PTC element;

each of which devices (a) having an initial resistance at 20° C. of at most 6 ohms;

(b) having a capacitance of at most 150 pF; and (c) meeting the requirements of UL11950 power contact test M-1, and (B) an additional insulating layer which surrounds the first and second devices, the first device, after being subjected to a 250 VAC/3 A test for a period of 15 minutes followed by a period of at least 1 hour during which no power is applied to the device, having a resistance which differs by at most 1.5 ohms from that the second device subjected to the same electrical test.

In a third aspect, the invention provides an electrical assembly comprising two laminar PTC devices electrically connected in parallel, each of which devices (1) comprises a laminar PTC element which (a) is composed of a conductive polymer composition which exhibits PTC behavior, (b) has first and second major surfaces, (c) has a thickness t mm, and (d) has a perimeter p mm, (2) has a first metal electrode attached to the first surface, (3) has a second metal electrode attached to the second surface, and (4) has a first insulating layer which comprises an electrically insulating material which conforms to at least part of the perimeter of the PTC element;

the assembly (A) having a capacitance which is at most 300 pF;

(B) having an initial resistance at 20° C. which is at most 6 ohms; and (C) meeting the requirements of UL1950 power contact test M-1.

In a fourth aspect, the invention provides an electrical telecommunications circuit for digital signals, said circuit having a tip and a ring section, which circuit comprises (1) a source of electrical power;

(2) a load;

(3) an electrical device according to the first aspect of the invention electrically in series with said source and load.

BRIEF DESCRIPTION OF THE DRAWINGS

The invention is illustrated by the drawings in which:

FIG. 1 is a plan view of the device of the first aspect of the invention;

FIG. 2 is an exploded view of the second aspect of the invention;

DETAILED DESCRIPTION OF THE INVENTION

Figure 3:
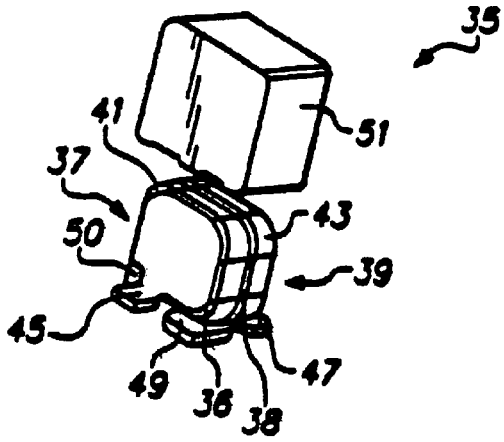
FIG. 3 is an exploded of the third aspect of the invention.

The electrical device of the invention comprises a laminar PTC element composed of a conductive polymer composition which exhibits PTC behavior. The conductive polymer composition comprises a polymeric component, and dispersed therein, a particulate conductive filler. The polymeric component comprises one or more polymers, one of which is preferably a crystalline polymer having a crystallinity of at least 10% as measured in its unfilled state by a differential scanning calorimeter. Suitable crystalline polymers include polymers of one or more olefins, particularly polyethylene such as high density polyethylene; copolymers of at least one olefin and at least one monomer copolymerisable therewith such as ethylene/acrylic acid, ethylene/ethyl acrylate, ethylene/vinyl acetate, and ethylene/butyl acrylate copolymers; melt-shapeable fluoropolymers such as polyvinylidene fluoride (PVDF) and ethylene/tetrafluoroethylene copolymers (ETFE, including terpolymers); and blends of two or more such polymers. For some applications it may be desirable to blend one crystalline polymer with another polymer, e.g. an elastomer or an amorphous thermoplastic polymer, in order to achieve specific physical or thermal properties, e.g. flexibility or maximum exposure temperature. The polymeric component generally comprises 40 to 90% by volume, preferably 45 to 80% by volume, especially 50 to 75% by volume of the total volume of the composition.

The particulate conductive filler which is dispersed in the polymeric component may be any suitable material, including carbon black, graphite, metal, metal oxide, conductive coated glass or ceramic beads, particulate conductive polymer, or a combination of these. The filler may be in the form of powder, beads, flakes, fibers, or any other suitable shape. The quantity of conductive filler needed is based on the required resistivity of the composition and the resistivity of the conductive filler itself. For many compositions the conductive filler comprises 10 to 60% by volume, preferably 20 to 55% by volume, especially 25 to 50% by volume of the total volume of the composition.

The conductive polymer composition may comprise additional components, such as antioxidants, inert fillers, non-conductive fillers, radiation crosslinking agents (often referred to as prorads or crosslinking enhancers, e.g. triallyl isocyanurate), stabilizers, dispersing agents, coupling agents, acid scavengers (e.g. $CaCO_3$), or other components. These components generally comprise at most 20% by volume of the total composition.

The conductive polymer composition exhibits positive temperature coefficient (PTC) behavior, i.e. it shows a sharp increase in resistivity with temperature over a relatively small temperature range. In this application, the term "PTC" is used to mean a composition which has an $R_{14}$ value of at least 2.5 and/or an $R_{100}$ value of at least 10, and it is preferred that the composition should have an $R_{30}$ value of at least 6, where $R_{14}$ is the ratio of the resistivities at the end and the beginning of a 14° C. range, $R_{100}$ is the ratio of the resistivities at the end and the beginning of a 100° C. range, and $R_{30}$ is the ratio of the resistivities at the end and the beginning of a 30° C. range. Generally the compositions used in devices of the invention show increases in resistivity which are much greater than those minimum values.

Suitable conductive polymer compositions for use in devices of the invention are disclosed in U.S. Pat. Nos. 4,237,441 (van Konynenburg et al), 4,545,926 (Fouts et al), 4,724,417 (Au et at), 4,774,024 (Deep et al), 4,935,156 (van Konynenburg et al), 5,049,850 (Evans et al), 5,250,228 (Baigrie et al), 5,378,407 (Chandler et al), 5,451,919 (Chu et al), 5,582,770 (Chu et al), and 5,747,147 (Wartenberg et al), and in copending, commonly assigned U.S. application Ser. No. 08/798,887 (Toth et al, filed Feb. 10, 1997), now U.S. Pat. No. 6,130,597. The disclosure of each of these patents and applications is incorporated herein by reference.

The conductive polymer is in the form of a laminar element having first and second generally parallel major surfaces. The element is sandwiched between first and second metal electrodes, the first of which is attached to the first surface of the PTC element and the second of which is attached to the second major surface. Preferably, the electrodes are in the form of metal foils, although a conductive ink, or a metal layer which has been applied by plating or other means can be used. Particularly suitable foil electrodes are microrough metal foil electrodes, including electrodeposited nickel foils and nickel-plated electrodeposited copper foil electrodes, in particular as disclosed in U.S. Pat. Nos. 4,689,475 (Matthiesen) and 4,800,253 (Kleiner et al), and in copending, commonly assigned U.S. Application No. 08/816,471 (Chandler et al, filed Mar. 13, 1997), now U.S. Pat. No. 6,570,483, the disclosure of each of which is incorporated herein by reference.

The PTC element has a thickness t mm which is at most 2.5 mm (0.100 inch), preferably at most 2.0 mm (0.080 inch), and is generally 1 to 2.5 mm (0.040 to 0.100 inch), as measured between the first and second electrodes. This is a thickness range which is particularly suitable for use in high voltage, e.g. 250 or 600 volt, applications. The element also has a perimeter p mm of at most 50 mm (1.97 inch), and is generally 20 to 50 mm (0.79 to 1.97 inch). This perimeter is the smaller of (1) the smallest circumference around the device and (2) the circumference measured at a distance halfway between the first and second electrodes. The measurement of the perimeter preferably includes any noticeable depressions, cracks, or inclusions.

Attached to the laminar element is a first insulating layer which comprises an electrically insulating material which conforms to at least part of the perimeter of the PTC element. Preferably, the first insulating layer conforms to at least 10% of the thickness around the perimeter of the PTC element, particularly at least 30% of the thickness, especially at least 50% of the thickness, more especially at least 70% of the thickness. In some embodiments it is preferred that the first insulating layer conform to substantially all of the thickness around the perimeter of the PTC element, wherein "substantially all" means at least 90% is covered by the first insulating layer. In some embodiments, the first insulating layer is substantially free of contact with the first and second electrodes, and preferably is totally free of contact with the first and second electrodes, wherein "substantially free" means that at most only 10% of the total surface area of the first and second electrodes is covered by the first insulating layer.

The first insulating layer may comprise any conformable coating material, but is preferably polymeric. Suitable materials include polyethylenes, ethylene copolymers, fluoropolymers, silicones, elastomers, rubbers, hot-melt adhesives, mastics, and gels. It is important that the layer conform and adhere to the conductive polymer composition of the PTC element, and that it maintain its conformance and adhesion during expansion of the conductive polymer during operation. Thus, it may be preferred that the material have similar thermal expansion properties to that of the PTC element. In order to enhance its performance under high voltage conditions, the insulating layer may comprise one or more fillers which are arc-suppressing materials, stress-grading materials, flame-retarding materials, or track-resistant materials.

The first insulating layer may be applied by any appropriate technique, e.g. it may be painted or sprayed on, or applied by pressure or melting, or applied by dip-coating. One particularly preferred technique is to apply a ring which is preferably a self-supporting component prior to attachment onto the PTC element. The ring may be prepared from a heat-recoverable article, e.g. heat-recoverable tubing or a heat-recoverable strip formed into a ring. A heat-recoverable article is an article the dimensional configuration of which may be changed by subjecting the article to heat treatment. In their most common form, such articles comprise a heat-shrinkable sleeve or tube made from a polymeric material exhibiting the property of elastic or plastic memory as described, for example, in U.S. Pat. Nos. 2,027,962 (Currie); 3,086,242 (Cook et al); and 3,597,372 (Cook), the disclosures of which are incorporated herein by reference. The polymeric material has been crosslinked during the production process so as to enhance the desired dimensional recovery. One method of producing a heat-recoverable article comprises shaping the polymeric material into the desired heat-stable form, subsequently crosslinking the polymeric material, heating the article to a temperature above the crystalline melting point (or, for amorphous materials the softening point of the polymer), deforming the article, and cooling the article while in the deformed state so that the deformed state of the article is retained. In use, because the deformed state of the article is heat-unstable, application of heat will cause the article to assume its original heat-stable shape. The heat-recoverable article, when recovered into contact with the PTC element, may act as the first insulating layer. Alternatively, the inner surface of the heat-recoverable article may be coated with a hot-melt adhesive or mastic which, when the article is heated and recovered, melts and/or flows into contact with the PTC element, providing a conformal coating and filling small voids or irregularities on the perimeter of the element. In this configuration, the heat-recoverable article may comprise a carrier member (generally the outer layer) and an inner adhesive member. The carrier member may remain after installation or it may be removed. The adhesive or mastic may itself contain a filler of the type described above to enhance its high voltage performance. When a heat-recoverable article is used, it is preferred that the inner perimeter of a completely recovered article (without a PTC element present) is somewhat less than the perimeter of the PTC element. This allows the recovered article to maintain excellent contact with the PTC element even after the expansion resulting from tripping the device into a high temperature state. Preferably the inner perimeter of the heat-recoverable article is at most 90%, particularly at most 85%, especially at most 80% that of the perimeter of the PTC element. The perimeter of the ring or the heat-recoverable article is preferably the same shape as the PTC element.

Devices of the invention are designed to have low device resistance and low capacitance, as well as small size. Because of the resistance limitations for digital telecommunications systems, these devices have been designed to have a resistance at 20° C. which is at most 6.0 ohms, preferably at most 5.0 ohms, particularly at most 4.0 ohms, and especially at most 3.0 ohms. The capacitance of the devices when measured at room temperature using Hewlett Packard 4191A and 4192A LCR meters for frequencies in the range 0.001 MHz–100 MHz, with no bias voltage, is at most 150 pF, preferably at most 50 pF, and particularly at most 20 pF. To minimize the footprint the device requires on a board, the devices will be made from PTC elements which are at most 2.5 mm (0.100 inch) thick. To accommodate high density packing of circuit boards into equipment, the devices can be designed to have a maximum height of 10.2 mm (0.40 inch) when mounted on a substrate such as a circuit board. The maximum height is the distance from the top of the device (including any insulating layers that may be present) to the surface of the substrate on which it is mounted. To further allow the reduction of resistance, this invention includes an assembly of PTC devices which are connected in parallel as shown below in FIG. 3.

Circuit protection devices of the invention are particularly suitable for passing the applicable power cross tests set forth in Underwriter's Laboratory Standard 1950, 3rd edition, the disclosure of which is incorporated herein by reference. In test M-1 specified therein, a circuit protection device is placed in series with a wiring simulator, such as a 1.6 A slo-blo fuse, and subjected to an electrical surge of 600 volts AC and 40 amps (short circuit) for a period of 1.5 seconds. In order to pass this requirement, the device must protect the wiring simulator (which must not be electrically stressed, e.g. if the wiring simulator is a fuse, it must not be blown), and the device must not char a cheesecloth indicator surrounding the device.

In addition, circuit protection devices of the invention may also pass the tests set forth in Bellcore specification GR-1089, the disclosure of which is incorporated herein by reference. In particular, the devices of the invention are particularly suitable for passing the Level 1 Surge 3 lightning test, in which the device is subjected to repeated electrical pulses having the following waveform. The electrical pulse must have a maximum risetime of 10 microseconds, defined as the time it takes for the voltage to increase from 10% of its peak value to 90% of its peak value, the pulse must have a minimum decay time of 1 millisecond, where the decay time is defined as the time it takes for the voltage to exponentially decay to 50% of its peak value, the peak voltage must be at least 1 kV, and the peak current must be at least 100 A. After 25 pulses of the alternating polarity of the prescribed electrical transient, the resistance of the device must not change by more than 1 ohm. In the past, it has been recommended to use an additional resistor in series with devices in order to pass this Level 1 Surge 3 test (see Raychem Circuit Protection Databook, October 1998, page 84). Devices of this invention can be designed to pass this requirement with no additional series resistance.

Figure 4:
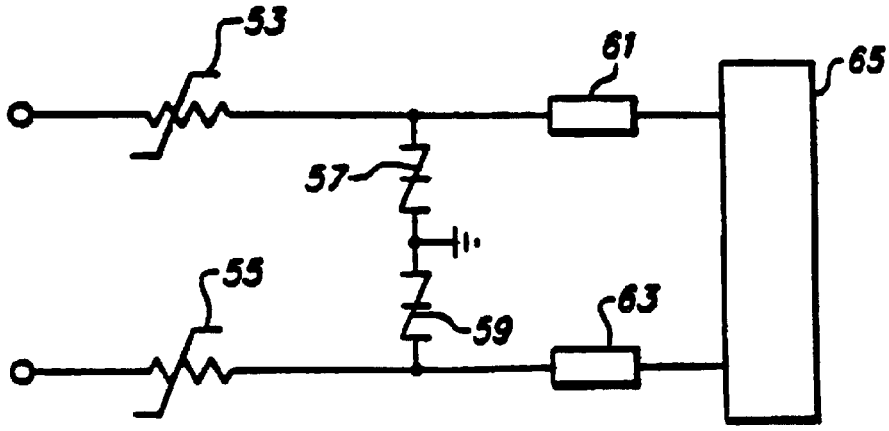
FIG. 4 is a circuit according to the fourth aspect of the invention.

Devices of the invention have been designed to be stable in resistance relative to a substantially similar device. Substantially similar devices are defined as devices which are the same shape and size, are made from the same PTC material composition, have electrodes and leads of the same material and dimensions, with resistances when measured at 20° C. which differ by at most 0.5 ohms. Since a telecommunications circuit must be carefully impedance-balanced to avoid unwanted noise and signal loss, and two PTC devices are often used in a circuit (as shown in FIG. 4), it is often desired that substantially similar devices be used in a circuit. Furthermore, it is desired that the device remain as well matched as possible following an electrical fault. Otherwise, the benefit of using a resettable device is minimized if after an electrical fault, large impedance mismatch develops, resulting in loss of signal and/or signal quality. Therefore, a device of the invention has been designed to be stable in resistance relative to a substantially similar device following an extended electrical fault. An electrical test is conducted in which two substantially similar devices are each subjected to 250 VAC, 3 A for 15 minutes, then allowed to sit under ambient conditions with no power applied to either device, and their resistances remeasured at 20° C. Following this test, the devices will differ in resistance from each other by at most 1.5 ohms, preferably at most 1.0 ohms. For certain applications and for certain board lay-outs, it may be desired to package substantially similar devices together into an assembly, as shown in FIG. 2. A reduced footprint for two devices can be achieved by packaging two devices together because of compact lead designs and because the inter-device spacings required for board lay-outs, which can be especially large for high voltage devices, are eliminated.

The invention is illustrated by the drawings in which FIG. 1 is a plan view of device 1 of the first aspect of the invention. PTC resistive element 3 is sandwiched between first and second metal foil electrodes 5,7 which are coated with first and second solder layers 11,13, respectively. First insulating layer 9 surrounds the perimeter of PTC element 3 and conforms to the shape of the PTC element.

FIG. 2 is an exploded view of the assembly 21 of the second aspect of the invention.

First electrical device 23 has an insulating layer 27 surrounding PTC element 26 and second electrical device 25 has an insulating layer 29 surrounding PTC element 28. Leads 31 and 31' are provided for both devices. An additional insulating layer 33, in the form of a box, surrounds both devices.

FIG. 3 is an exploded view of the assembly 35 of the third aspect of the invention.

First electrical device 37 comprising PTC element 36 has an insulating layer 41 and second electrical device 39 comprising PTC element 38 has an insulating layer 43. Lead 49 is electrically attached to the internal electrodes of both devices. Clip 50 extends from lead 45 to lead 47, electrically connecting the external electrodes of both devices. Electrical connections made by lead 49 and clip 50 cause the two devices to be connected in parallel. Alternatively, clip 50 can be eliminated, and the devices connected in parallel through connections made to the leads via the contact pads for the assembly on a circuit board.

FIG. 4 is a circuit according to the fourth aspect of the invention. Two PTC electrical devices 53,55 are provided in series with the equipment to be protected, element 65. Additionally the circuit contains overvoltage protection elements 57 and 59 and line resistors 61 and 63.

The foregoing detailed description of the invention includes passages which are chiefly or exclusively concerned with particular parts or aspects of the invention. It is to be understood that this is for clarity and convenience, that a particular feature may be relevant in more than just the passage in which it is disclosed, and that the disclosure herein includes all the appropriate combinations of information found in the different passages. Similarly, although the various figures and descriptions thereof relate to specific embodiments of the invention, it is to be understood that where a specific feature is disclosed in the context of a particular figure, such feature can also be used, to the extend appropriate, in the context of another figure, in combination with another feature, or in the invention in general.

It will be understood that the above-described arrangements of apparatus and the methods therefrom are merely illustrative of applications of the principles or this invention and many other embodiments and modifications may be made without departing from the spirit and scope of the invention as defined in the claims.

What is claimed is:

1. An electrical assembly comprising (A) first and second electrical devices, each of which devices comprises (1) a laminar PTC element which (a) comprises a conductive polymer composition which exhibits PTC behavior, (b) has first and second major surfaces, (c) has a thickness t mm which is at most 2.5 mm, and (d) has a perimeter p mm which is at most 50 mm;

(2) a first metal foil electrode which is attached to the first surface of the PTC element;

(3) a second metal foil electrode which is attached to the second surface of the PTC element; and (4) a first insulating layer which comprises an electrically insulating material which conforms to at least part of the perimeter of the PTC element;

each of which devices (a) having an initial resistance at 20° C. of at most 6 ohms;

(b) having a capacitance of at most 150 pF; and (c) meeting the requirements of UL1950 power contact test M-1, and (B) an additional insulating layer which surrounds the first and second devices, the first device, after being subjected to a 250 VAC/3 A test for a period of 15 minutes followed by a period of at least 1 hour during which no power is applied to the device, having a resistance which differs by at most 1.5 ohms from that the second device subjected to the same electrical test.

2. An assembly according to claim 1, wherein the additional insulating layer comprises a self-supporting box.

3. An electrical assembly comprising two laminar PTC devices electrically connected in parallel, each of which devices (1) comprises a laminar PTC element which (a) is composed of a conductive polymer composition which exhibits PTC behavior, (b) has first and second major surfaces, (c) has a thickness t mm, and (d) has a perimeter p mm, (2) has a first metal electrode attached to the first surface, (3) has a second metal electrode attached to the second surface, and (4) has a first insulating layer which comprises an electrically insulating material which conforms to at least part of the perimeter of the PTC element;

the assembly (A) having a capacitance which is at most 300 pF;

(B) having an initial resistance at 20° C. which is at most 6 ohms; and (C) meeting the requirements of UL1950 power contact test M-1.

4. An assembly according to claim 3, which further comprises an additional insulating layer which surrounds the device.

5. An electrical device according to claim 4, wherein the additional insulating layer comprises a self-supporting box.

* * * * *